US008632223B2

(12) United States Patent
McDermott

(10) Patent No.: US 8,632,223 B2
(45) Date of Patent: Jan. 21, 2014

(54) MULTI-FUNCTIONAL ILLUMINATOR

(76) Inventor: Kevin McDermott, Rockledge, FL (US)

( * ) Notice: Subject to any disclaimer, the term of this patent is extended or adjusted under 35 U.S.C. 154(b) by 0 days.

(21) Appl. No.: 13/451,703

(22) Filed: Apr. 20, 2012

(65) Prior Publication Data

US 2013/0279157 A1 Oct. 24, 2013

(51) Int. Cl.
*F21V 33/00* (2006.01)

(52) U.S. Cl.
USPC ..... 362/296.01; 362/186; 362/191; 362/326

(58) Field of Classification Search
USPC ..... 362/186, 296.01, 306, 326, 307, 190, 362/191
See application file for complete search history.

(56) References Cited

U.S. PATENT DOCUMENTS 1,765,110 A * 6/1930 Stroke ..... 200/60
4,257,085 A * 3/1981 Kimmel ..... 362/186
5,161,879 A * 11/1992 McDermott ..... 362/206
2009/0294693 A1* 12/2009 Nath ..... 250/459.1

* cited by examiner

*Primary Examiner* — Laura Tso
(74) *Attorney, Agent, or Firm* — Lowe Hauptman & Ham, LLP

(57) ABSTRACT

A multi-functional illuminator comprising a directional illuminator and a removably attachable optic. The directional illuminator is typified by a flashlight projecting light forward to illuminate an object in front of the flashlight. The present invention discloses an optic removably attached to the directional illuminator intersecting and redistributing the light emitted by the directional illuminator to provide illumination satisfactory for tasks not achievable with the directional light beam. The optic employs reflection, refracting and/or diffusing optics to efficiently redirect the light. The optic can be designed so that the redirected light is distributed throughout the hemisphere, concentrated about a plane perpendicular to the axis of the directed light beam or to effect any one of a plurality of possible illumination patterns. If the directional illuminator comprises a covert design minimizing its lateral visibility, the optic can change this characteristic making it highly laterally visible.

19 Claims, 8 Drawing Sheets

MULTI-FUNCTIONAL ILLUMINATOR

BACKGROUND OF THE INVENTION

1. Field of Invention

Directional illuminators including flashlights are used by soldiers, policemen, firemen, mechanics, construction workers, etc. Flashlights emit light typically having spot or directional light beams concentrated about the axis of the flashlight to illuminate distant objects or to provide increased intensity when viewing nearby objects. Illuminators such as these are of limited use when one wishes to illuminate a room. The spotlight beam pattern they provide would only illuminate a single corner of a room leaving the rest of the room dark. In order to properly illuminate a room the light emerging from the illuminator should have an emerging light pattern substantially evenly distributed throughout a hemisphere. Directional illuminators such as flashlights are also ineffective if one wishes to emit a signal visible from all angles of approach. For example, a person lost in the wilderness may wish to emit a light beam concentrated about the horizontal and visible throughout a 360° azimuth to aid rescue crews in locating him. A directional illuminator, such as a flashlight would be inadequate as a 360° rescue signal because it can only direct its emitted light in a single direction.

Other occupations such as construction workers and mechanics frequently employ directional illuminators to illuminate objects at a distance or to provide high intensity illumination of nearby objects. Directional illuminators perform this function well. However, there are situations where the directional illuminator cannot be positioned as needed to direct its beam as needed. For example, a mechanic may need to illuminate the underside of a transmission or a construction worker may need to connect a pipe with neither having hands available to hold a flashlight and direct the light. The directional illuminator is not acceptable for those situations. If the flashlight had the ability to provide hemispherical illumination then it would provide acceptable illumination even though its housing could not be positioned as needed to direct its light beam as needed. In this situation the hemispherical light would illuminate the entire work zone without the need for precise disposition of the flashlight.

As a result of these deficiencies in directional illuminators it is common for soldiers and other professionals to carry a plurality of illuminating devices so that they can create the proper illumination for a plurality of situations. This prior art procedure of carrying a plurality of lighting devices is not desirable because it increases the expense of the equipment and the weight that must be carried.

2. Prior Art

Prior art includes a Flashlight For Covert Applications U.S. Pat. No. 5,161,879 issued to McDermott (the present applicant) which discloses a battery-powered flashlight with LED lamps in a circular pattern emitting a beam of light surrounded by an opaque hood. The light emitted by the aforementioned device would constitute a directional light beam. This covert flashlight (illuminator), by virtue of the opaque hood, includes the covert feature of restricting lateral visibility (visibility from the side). However, the opaque hood in restricting visibility from the side also, in some situations, prevents the light from being useful for other tasks. The covert flashlight is not visible throughout a 360° azimuth and therefore is not useful as a signal or rescue light which requires 360 degree visibility. In addition since the directional light beam is not distributed throughout the hemisphere the flashlight is not useful when it is necessary to illuminate a room. Finally the flashlight cannot be placed on the ground with its directional light pointed upward. This is an objective which is achievable using a right angle flashlight and which may be required by a mechanic.

Although the covert prior art flashlight is limited in that it only emits light having a directional beam pattern forward of the flashlight parallel to the axis of the flashlight it can emit a variety of colors. FIG. 9 of the prior art patent discloses a circular pattern of LED lamps including a plurality of lamps of a first color and a plurality of lamps of a second color (infrared is considered a color for this discussion even though it is not visible to the naked eye) permitting the user of the flashlight to select and change the color of the light emitted. In the covert flashlight one of the colors is typically infrared; however, it would be easy to substitute any second color for the infrared described.

Prior art also includes commercially available flashlights or directional illuminators which were not designed to be covert. Included within this group would be flashlights having LED light sources and catadioptric lenses or reflective parabolas. The typical high-tech commercial flashlight includes a threaded bezel, a LED light source and a light concentrating reflector or a light concentrating catadioptric lens. Side emitted light can be considered a benefit as it provides potentially useful illumination towards the side of the flashlight. Therefore, the threaded bezel of the commercial flashlight does not require an opaque hood with a recessed lens or cover, as employed in the covert flashlight, if the design seeks to benefit from the advantages of side emitted light.

Prior art also includes flashlights with special brackets which hold the flashlight in a variety of dispositions thereby aiming the directional light beam as required to illuminate objects not aligned with the axis of the flashlight.

Prior art also includes right angle flashlights which emit a directional light beam directed at a right angle relative to the axis of the flashlight. Many of these are issued to soldiers during basic training.

OBJECTS AND ADVANTAGES

The objects and advantages of the present invention are to provide a single multi-functional illuminator which can provide excellent illumination for a variety of different tasks, thereby eliminating the need for those persons performing a plurality of functions to carry a plurality of illuminators. The present invention achieves this objective with a cost-effective optic that can be removably attached to a directional illuminator (flashlight) to intersect and redirect the directional light beam and thereby form a second light distribution pattern to achieve a second lighting objective.

The present invention comprises a light redirecting optic which employs either a single type of light bending optic or a combination of types of light bending optics to achieve the requirements of a particular lighting objective. Types of light bending optics can include partial or total internal reflection, reflective, refractive or diffusing optics alone or in combination to redirect the light. The exact optical light bending system to be employed depends upon the light distribution of the directional light beam, the required distribution of the emerging light, the material used to construct the optic and a number of other parameters. The optical system including the types of light bending optics necessary to achieve a particular lighting objective can be designed using classical optical design techniques once the requirements of a particular lighting objective and its related parameters are established. If the redirected light is required to be in the form of a light beam having a first portion of the redirected light concentrated about a plane perpendicular to the direction of the axis of the directional light beam (typically the horizontal plane) and a second portion distributed throughout a hemisphere about the axis of the directional light beam the present invention can effectively employ total internal reflection.

The multi-functional illuminator of the present invention can emit light having two substantially different emerging light patterns. It can emit a directional light beam and with that emitted light can function as an excellent directional spot or flood light. It can also emit a second light pattern substantially different from the directional light beam when the optic is installed. For example, with the optic installed the multi-function illuminator can function as an excellent 360 degree signal device. Alternatively, the multi-functional illuminator of the present invention can be a directional illuminator emitting a spot beam, then upon installation of the optic, emit a light evenly distributed throughout the hemisphere providing light for a person trying to illuminate a small tent or room.

Covert flashlights are necessary for the military. The military also has need for signal lighting which can be visible throughout the azimuth. The military also has need for illuminators to illuminate the interior of tents or the cargo space of military vehicles. The multi-functional illuminator of the present invention can provide the type of illumination required for a plurality of the above-mentioned tasks. For example, a military pilot will typically be required to carry a covert flashlight employing an LED light source, an opaque hood and a directional light beam to avoid attention and detection when behind enemy lines. In addition he may be required to carry a signal light having a 360 degree azimuthal beam to attract attention for those situations when he needs to be located by friendly forces. Since the multi-functional illuminator of the present invention can emit the type of light necessary for a covert directional illuminator and also—upon installation of the optic of the present invention—emit the type of light necessary for a 360° signal it can replace the two lights previously required. This saves money and reduces the weight of the equipment that the pilot is required to carry.

It is noteworthy to realize that a single multi-functional illuminator having a directional light beam can also emit a plurality of alternate emerging light patterns if a plurality of alternate optics are available. For example, a single multi-functional illuminator having a directional light beam can employ a first optic of a first optical configuration to create a 360° light beam concentrated about a horizontal. That same multi-functional illuminator can also employ a second optic of a second optical configuration to create a redirected light evenly distributed throughout a hemisphere. The present application employs a common lanyard to permit a plurality of optics to be attached to a single multi-functional illuminator.

The present invention would also find application for commercial flashlights that are not covert. First responders, mechanics, and many people that employ flashlights would benefit if a flashlight using the optic of the present invention could redistribute its emerging light to accomplish a variety of tasks.

In one configuration the present invention redirects the directional light beam so that the redirected light emerges as a directional beam perpendicular to the axis of the flashlight. This configuration does not require the redirected light to include a 360 degree beam spread because the beam spread, typically between 2 and 30 degrees, found on typical flashlights would be acceptable for most tasks. This configuration substitutes for the common right angle flashlight as it permits the user of the flashlight to lay the flashlight on the floor of a room and illuminate the ceiling or walls of the room. This feature avoids special brackets or holders which are used in prior art to position directional illuminators permitting them to be illuminate objects not in line with the axis of the flashlight.

SUMMARY

In accordance with the present invention a multi-functional illuminator comprising an illuminator having a transparent face, a directional light beam emerging from said face concentrated about a beam axis, an optic removably attachable to said illuminator about said face for intersecting said directional light beam and redirecting said directional light beam towards a plane perpendicular to said beam axis.

DRAWINGS

Figures

Figure 1:
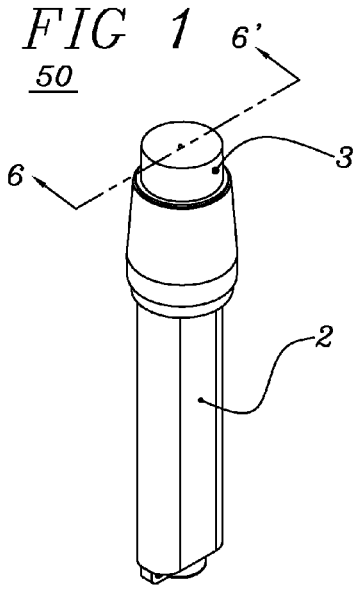
FIG. 1 is a perspective view of multi-functional illuminator 50
Figure 3:
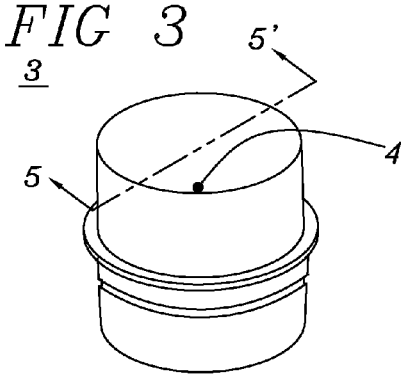
FIG. 3 is optic 3 removed from FIG. 1
Figure 8:
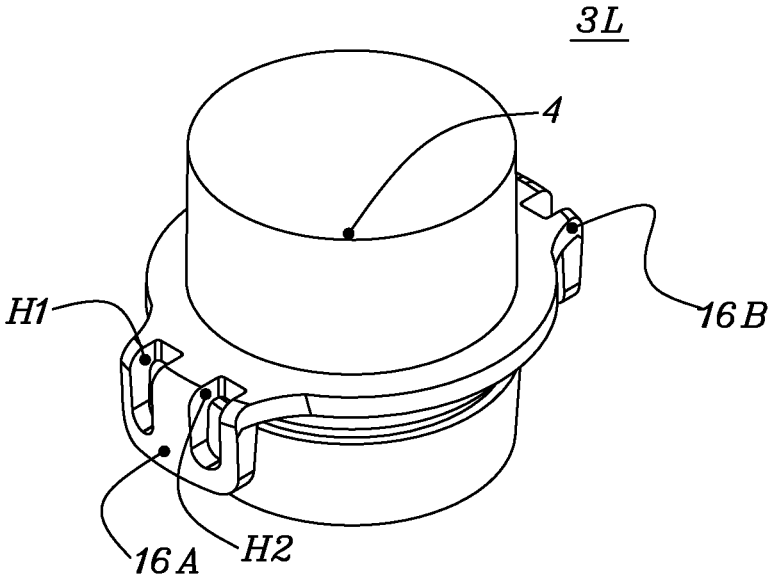
Figure 9:
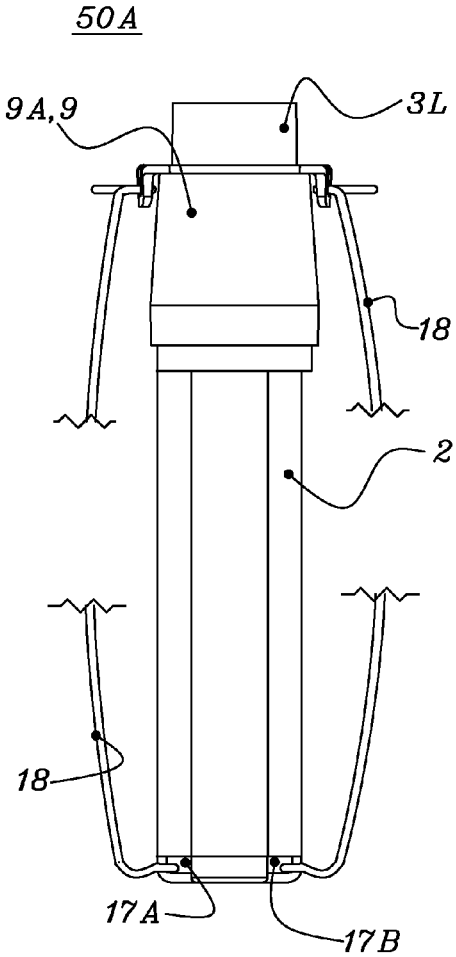

FIG. 8 is a perspective view of lanyard optic 3L an optional configuration of FIG. 3 in which optic 3 has lanyard arms added FIG. 9 is a perspective view of alternate multi-functional illuminator 50A an optional configuration of multi-functional illuminator 50 from FIG. 1 with lanyard optic 3L replacing optic 3

Figure 10:
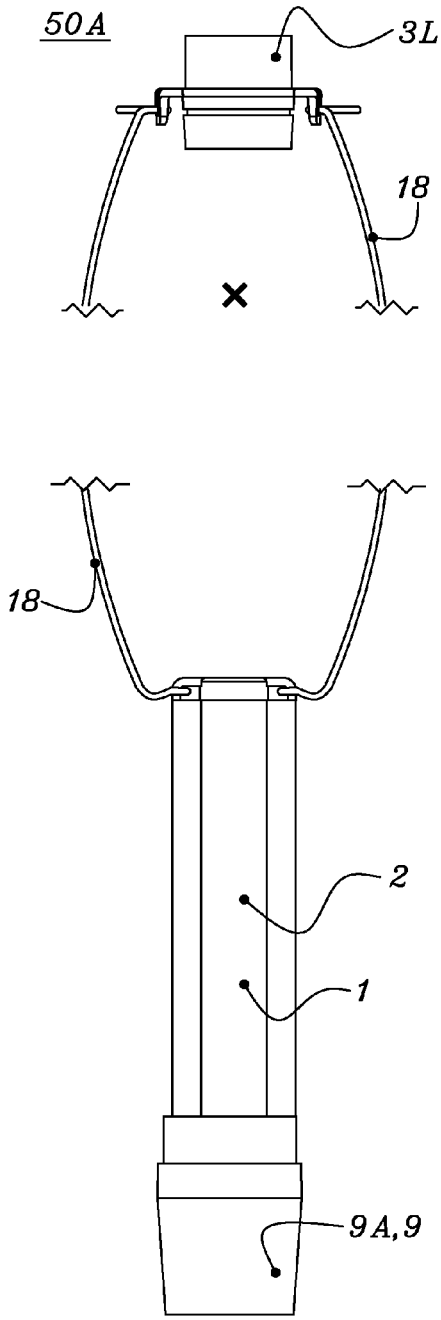
Figure 11:
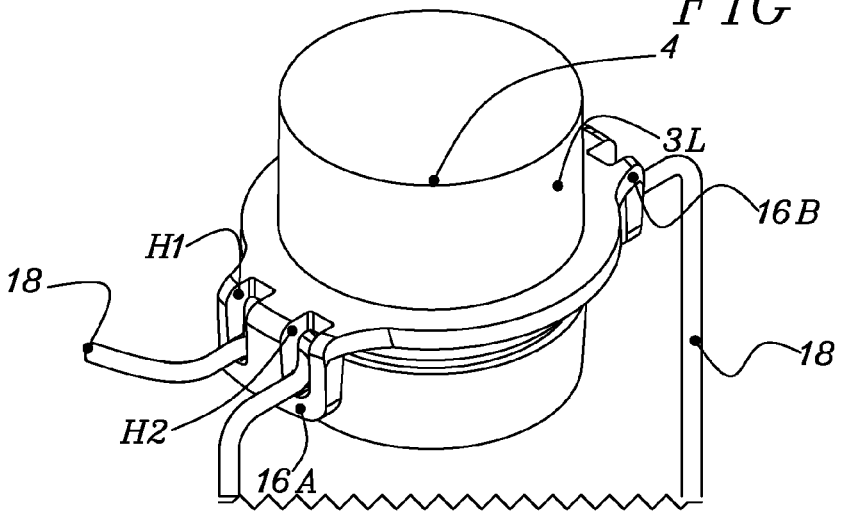

FIG. 10 is a front view of multi-functional illuminator 50A from FIG. 9 positioned for placement about a user's neck FIG. 11 is a perspective view of lanyard optic 3L removed from FIG. 10

Figure 5:
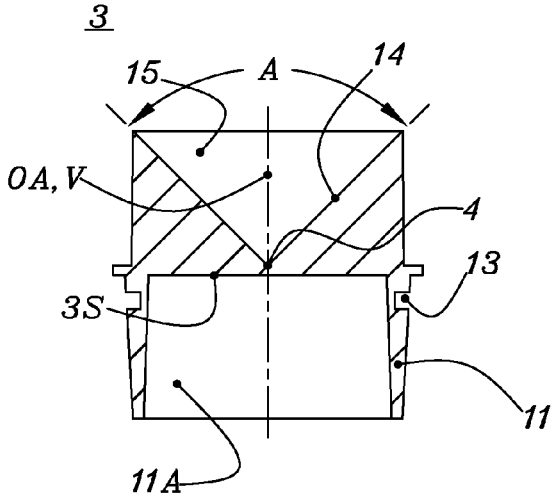
FIG. 5 is a sectional view taken across 55' of FIG. 3
Figure 6:
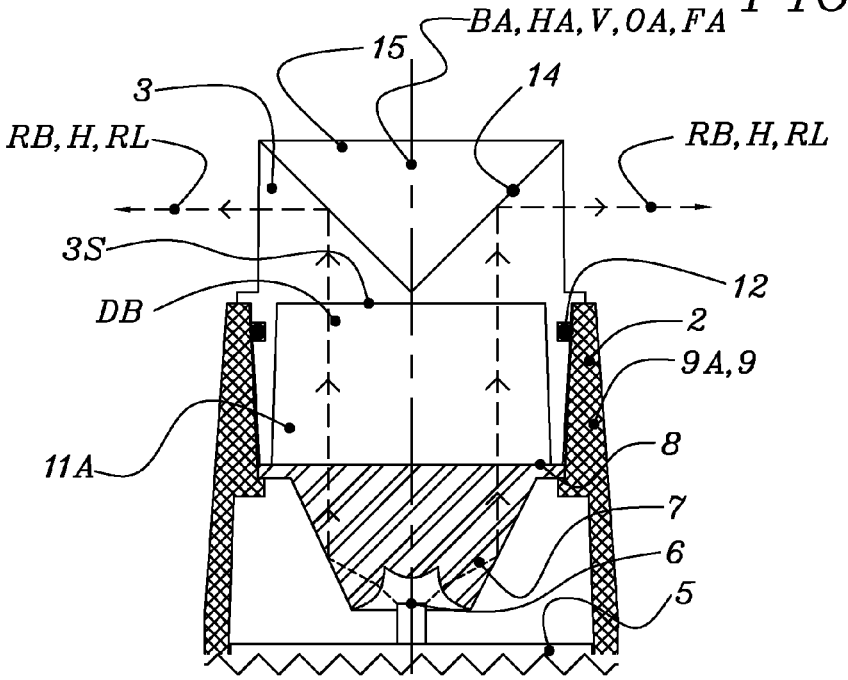
FIG. 6 is a partial sectional view taken across 66' of FIG. 1
Figure 12:
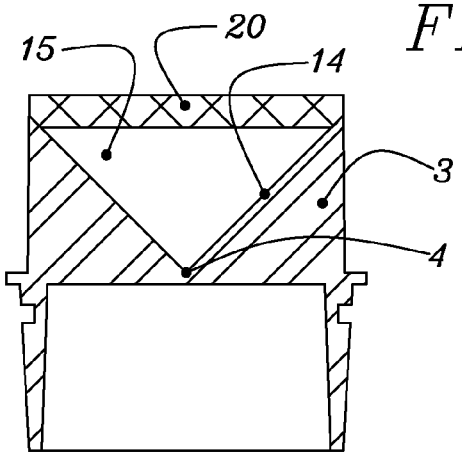
Figure 13:
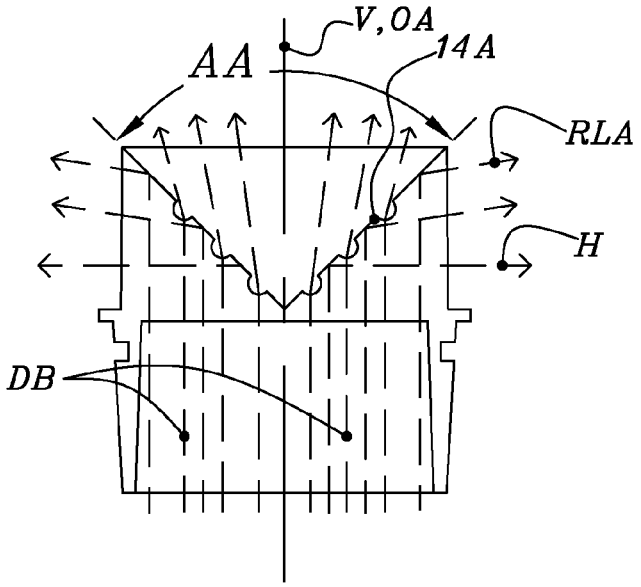
Figure 14:
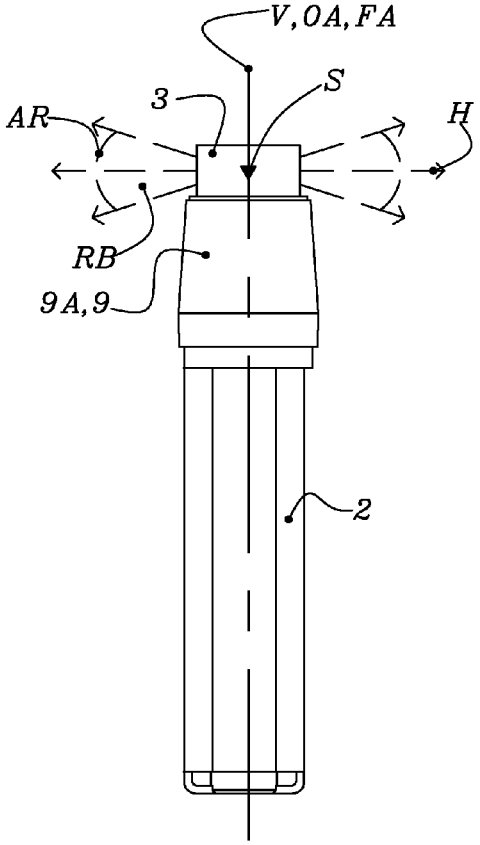
Figure 15:
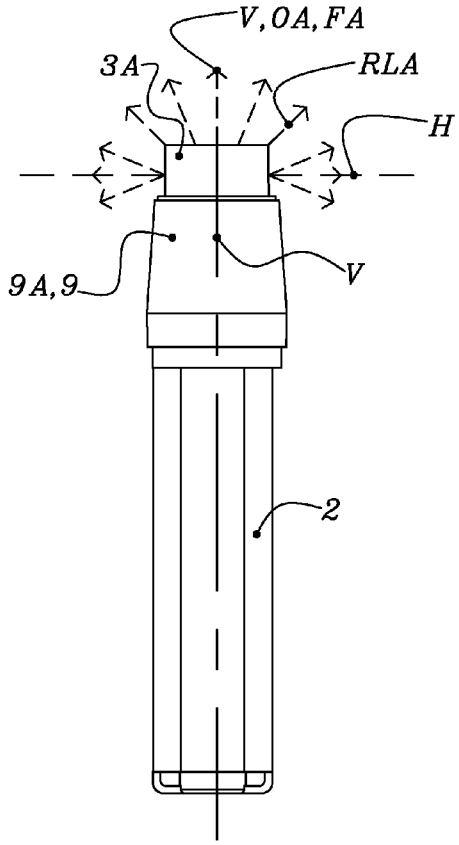
Figure 16:
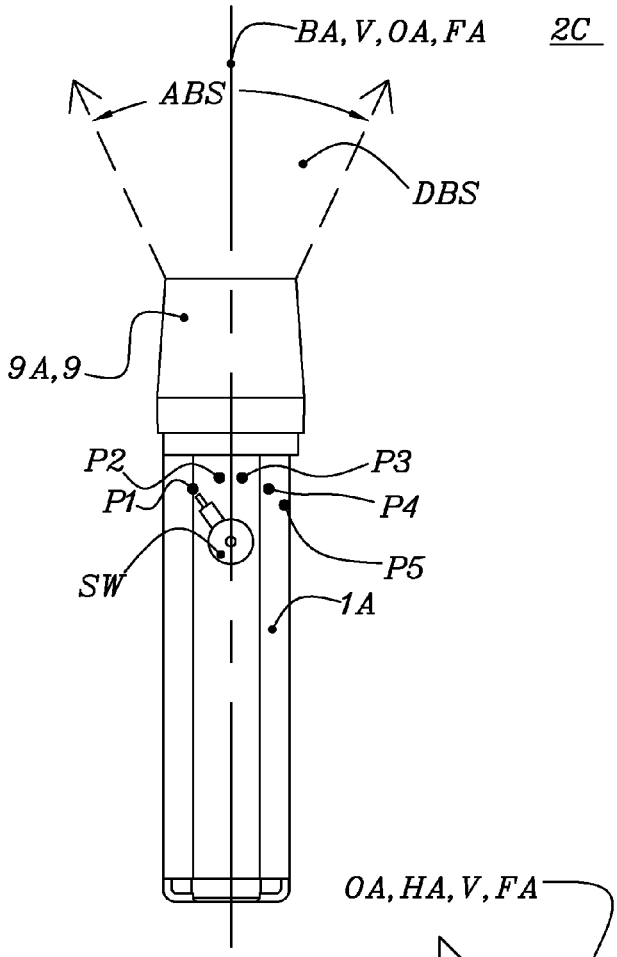
Figure 17:
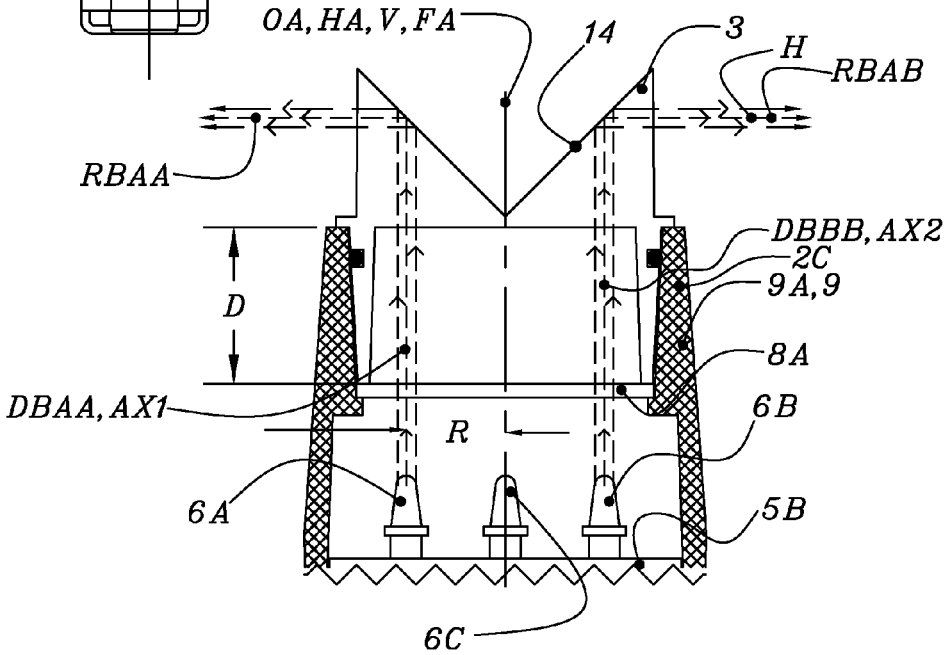

FIG. 12 is a partial sectional view similar to FIG. 5, except top 20 has been added FIG. 13 is a partial sectional view of optic 3A similar to optic 3 of FIG. 5, except surface 14 has been replaced with alternate reflective surface 14A FIG. 14 is a front view of multi-functional illuminator 50 from FIG. 1 showing redirected light beam RB FIG. 15 is front view of multi-functional illuminator 50 from FIG. 1 with optic 3 replaced by optic 3A showing emerging alternate redirected light RLA FIG. 16 is front view of substitute covert illuminator 2C similar to covert illuminator 2 of FIG. 1 showing emerging substitute central directional light beam DBS and including switch SW FIG. 17 is a partial sectional view similar to FIG. 6 except in FIG. 17 optic 3 has been installed on substitute covert illuminator 2C from FIG. 16

Figure 18:
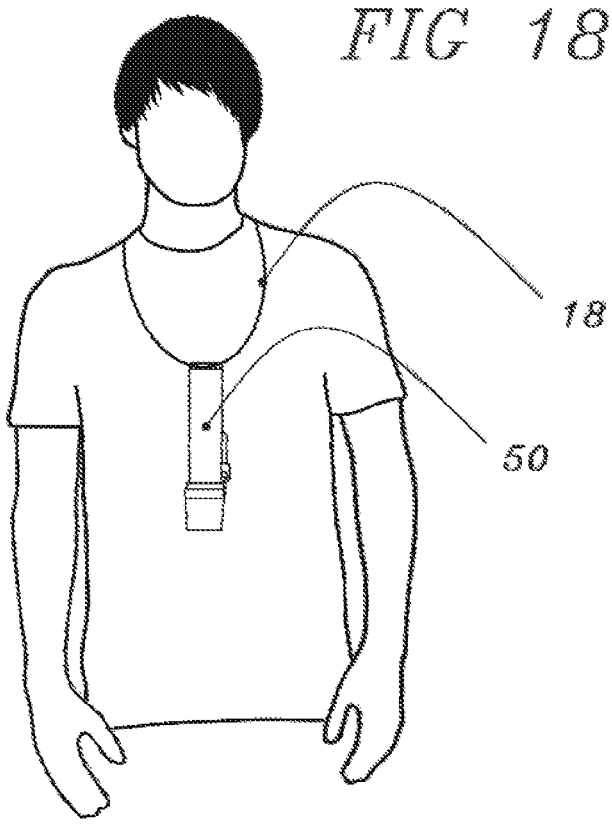
Figure 19:
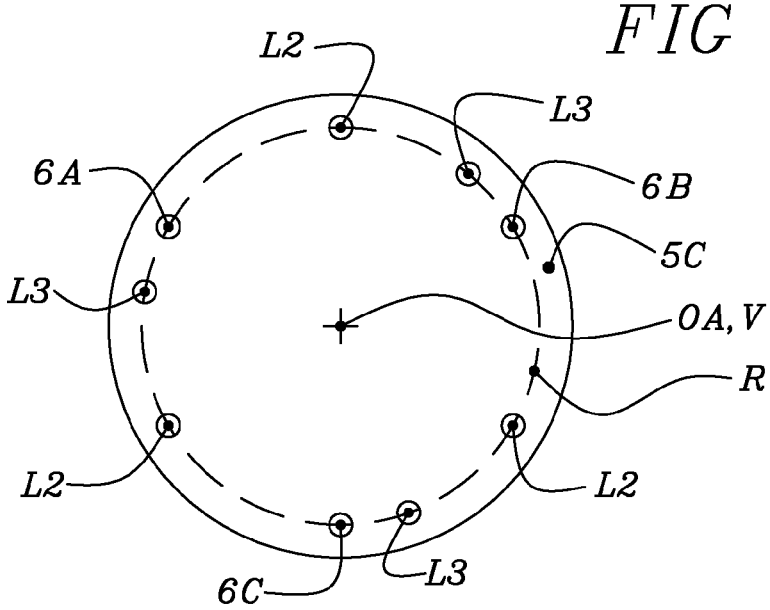

FIG. 18 is a front view of alternate multi-functional illuminator 50A from FIG. 10 installed on a person FIG. 19 is a plan view of printed circuit board 5C similar to printed circuit board 5B from FIG. 17 except additional LED lamps have been added to provide a plurality of colors

| DRAWINGS-Reference Letters | | DRAWINGS-Reference Numerals | |
|---|---|---|---|
| A | Included Angle | 1 case | 1A substitute case |
| AA | Alternate Included Angle | 2 covert illuminator | 2C substitute covert illuminator |
| ABS | Included Angle of Substitute Directional Light Beam | 3 optic<br>3L lanyard optic | 3A alternate optic<br>3S first surface |
| AR | Included Angle of Redirected Light Beam | 4 vertex | 5 one LED printed circuit board |
| AV | Angle of Viewing | 5B three LED printed circuit board | 5C plural LED printed circuit board |
| AX1 | First LED Lamp 6A Directional Light Beam Axis | 6 LED lamp | 6A first T 1¾ LED lamp |
| AX2 | Second LED Lamp 6B Directional Light Beam Axis | 6B second T 1¾ LED lamp<br>7 catadioptric optic | 6C third T 1¾ LED lamp<br>8 face |
| BA | Central Directional Light Beam Axis | 8A discrete face | 9 bezel |
| | | 9A hood | 10 reflector |
| D | Hood Depth | 11 skirt | 11A skirt void |
| DB | Central Directional Light Beam | 12 o-ring | 13 o-ring groove |
| DBA | Alternate Central Directional Light Beam | 14 reflective surface | 14A alternate redirecting surface |
| DBAA | Alternate Directional Light Beam from First LED lamp 6A | 15 air pocket | 16A first lanyard arm |
| DBBB | Alternate Directional Light Beam from Second LED Lamp 6B | 16B second lanyard arm<br>17B light lanyard hole two | 17A light lanyard hole one<br>18 lanyard |
| DBS | Substitute Light Beam | 20 top<br>50A alternate multi-functional illuminator | 50 multi-functional illuminator |
| FA | Illuminator Longitudinal Axis | | |
| H | Horizontal Reference Plane | | |
| H1 | Lanyard Hole One | | |
| H2 | Lanyard Hole Two | | |
| HA | Hood Axis | | |
| OA | Optic Axis | | |
| P1 | Switch Position One | | |
| P2 | Switch Position Two | | |
| P3 | Switch Position Three | | |
| P4 | Switch Position Four | | |
| P5 | Switch Position Five | | |
| R | LED Radius | | |
| RB | Redirected Light Beam | | |
| RBA | Alternate Redirected Light Beam | | |
| RBAA | Alternate Redirected Light Beam from 6A | | |
| RBAB | Alternate Redirected Light Beam from 6B | | |
| RL | Redirected Light | | |
| RLA | Alternate Redirected Light Intense Spot | | |
| S | Intense Spot | | |
| SW | Switch | | |
| V | Vertical Reference | | |
| VIEW A | View A Direction | | |
| X | Lanyard Loop Opening | | |

OPERATIONAL DESCRIPTION OF THE PREFERRED EMBODIMENT FIGS. 1-19

FIG. 1 is a perspective view of multi-functional illuminator 50 the preferred embodiment of the present invention. Multi-functional illuminator 50 includes optic 3 removably attached to prior art covert illuminator 2.

Figure 2:
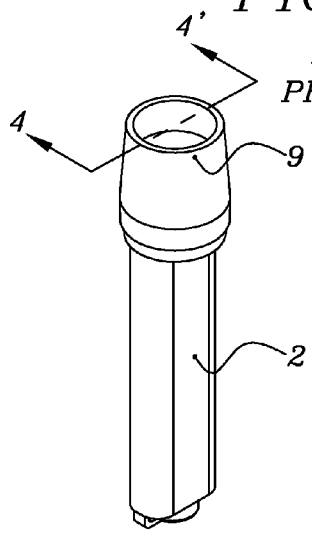
FIG. 2 is prior art covert illuminator 2 removed from FIG. 1

FIG. 2 is a perspective view of prior art covert illuminator 2 removed from FIG. 1. Covert illuminator 2 is prior art having an LED lamp energized by batteries within case 1 and with its emitted light a directional light beam.

FIG. 3 is a perspective view of optic 3 removed from FIG. 1.

Figure 4:
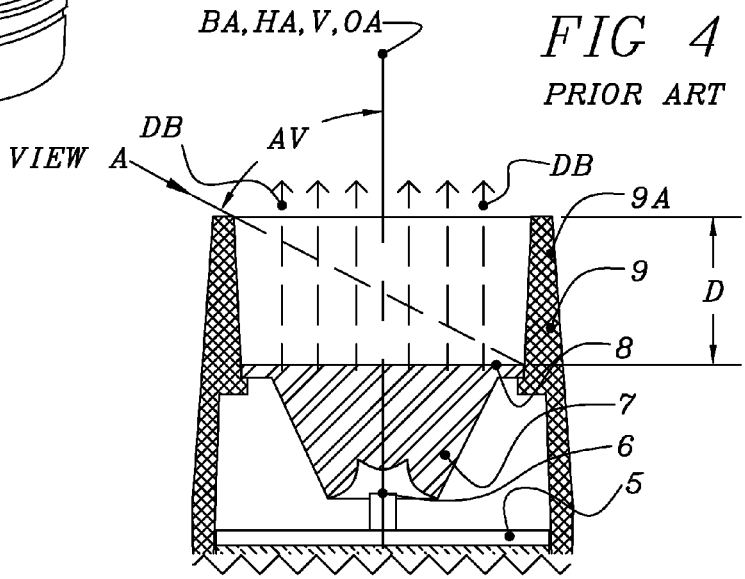
FIG 4 PRIOR ART
FIG. 4 is a partial sectional view of prior art covert illuminator 2 taken across 44' of FIG. 2

FIG. 4 is a partial sectional view of prior art covert illuminator 2 taken across line 44' of FIG. 2. In FIG. 4 LED lamp 6 is attached to LED printed circuit board 5, which is employed to bring power from batteries (not shown) within covert illuminator 2 to LED lamp 6. Light emitted from LED lamp 6 positioned on central directional light beam axis BA passes through catadioptric lens 7, where it is concentrated about central directional light beam axis BA to form central directional light beam DB which emerges from covert illuminator 2 at face 8. Optic axis OA of optic 3, vertical reference V, central directional light beam axis BA and hood axis HA in FIG. 4 are all coincident, however these relationships can change for other configurations of the present invention. Central directional light beam DB is shown as totally parallel to vertical reference V without divergence to simplify the current explanation, however it usually will have some measure of divergence about vertical reference V. Divergence of central directional light beam DB is achievable by changes in the optical design such as adjustments to the shape of catadioptric lens 7. Catadioptric lens 7 and face 8 are shown as a single molded component, however they can also be separate components. Catadioptric lens 7 and face 8 are attached to bezel 9. Bezel 9 is typically threaded onto case 1 of covert illuminator 2. Bezel 9 is molded of an opaque resin and includes hood 9A having hood axis HA coincident with vertical reference V. Face 8 is disposed about bezel 9 within hood 9A centered about vertical reference V and recessed within bezel 9 at hood depth D which should be at least 0.2 inches. Hood 9A about recessed face 8 substantially improves the covert nature of covert illuminator 2 by preventing observers from viewing face 8—which is illuminated and more easily noticed—unless they are within angle of viewing AV relative to vertical reference V. Increasing hood depth D—the distance face 8 is recessed within tubular hood 9A reduces the detectability or signature of covert illuminator 2 by reducing angle of viewing AV. The View A direction diverges from vertical reference V by angle of viewing AV. Observers viewing covert illuminator 2 from directions at or beyond the View A direction—at angles of view exceeding angle of viewing AV—would not see face 8. Central directional light beam DB emerges from face 8 of covert illuminator 2 as light concentrated about central directional light beam axis BA, which is coincident with vertical reference V. Central directional light beam DB can diverge from central directional light beam axis BA and still be acceptable depending upon the anticipated use of covert illuminator 2. Bezel 9 is opaque, threaded onto case 1 and includes hood 9A. Non-covert designs which include transparent bezels with and without hoods can also benefit from the optic of the present invention. In addition designs which secure face 8 to the illuminator without a discrete bezel can benefit from the optic of the present invention.

FIG. 5 is a sectional view of optic 3 taken across line 55' of FIG. 3. Optic 3 is typically molded of a highly transparent plastic such as polycarbonate or acrylic. Optic 3 has a cylindrical exterior contour. One end of optic 3 includes air pocket 15 formed by highly polished reflective surface 14 having a conical shape defined by included angle A and vertex 4 which is coincident with vertical reference V and optic axis OA. The other end of optic 3 comprises skirt 11 which is tubular in shape encompassing skirt void 11A. Skirt 11 includes o-ring groove 13. All surfaces of optic 3 are surfaces of revolution about vertical reference V. Included angle A is approximately 84 degrees. This angle is selected to effect total internal reflection at reflective surface 14. Included angle A can vary from 84 degrees depending upon a number of factors including the transparent material selected for optic 3, the angle of impinging light and the percentage of impinging light which reflective surface 14 is designed to reflect.

FIG. 6 is a partial sectional view taken across 66' of FIG. 1. It shows optic 3 which is removably attachable to covert illuminator 2 attached to covert illuminator 2 about face 8 with o-ring 12 installed in o-ring groove 13 creating a watertight seal against hood 9A. As described in FIG. 4, central directional light beam DB emerges from face 8. It then passes through skirt void 11A and intersects optic 3 at first surface 3S. It enters optic 3 and subsequently intersects reflective surface 14 where it is reflected emerging as redirected light RL which takes the form of redirected light beam RB concentrated about horizontal reference plane H and substantially evenly distributed throughout the 360 degree azimuth. Reflective surface 14 is angled relative to central directional light beam DB, such that it employs total internal reflection to reflect central directional light beam DB.

Figure 7:
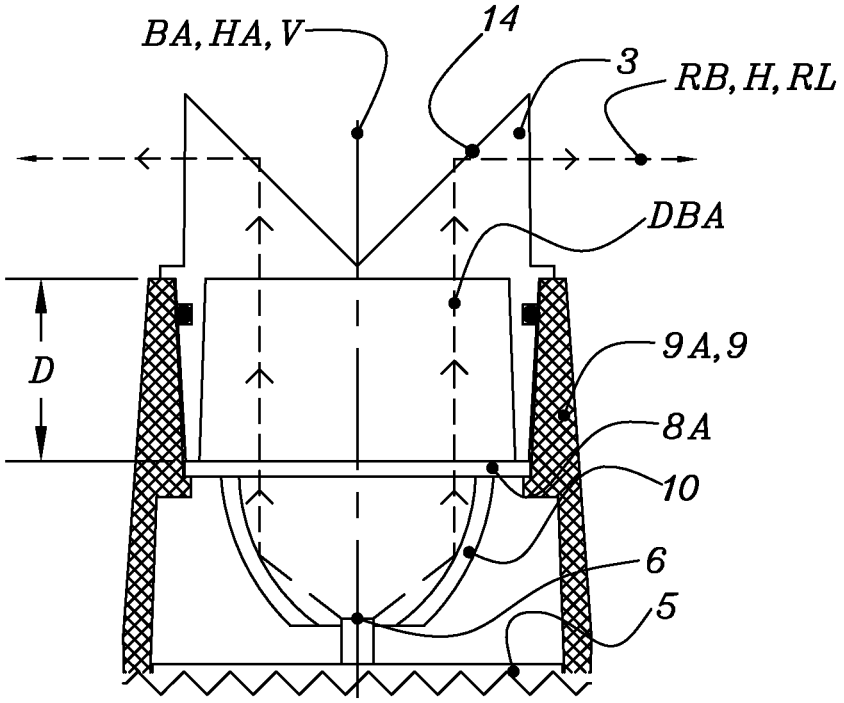
FIG. 7 is a partial sectional view similar to FIG. 6, except catadioptric lens 7 is replaced by reflector 10

FIG. 7 is similar to FIG. 6 except integral catadioptric lens 7 and face 8 have been replaced by discrete parabolic reflector 10 and discrete face 8A. It is well known that both a catadioptric optic and a reflector can concentrate light from an LED lamp into a directional light beam. However they differ substantially in efficiency, cost, their interaction with the various LED light sources and the intensity pattern of their emerging light beams. The FIG. 7 configuration would produce alternate central directional light beam DBA replacing central directional light beam DB shown in FIG. 6. Alternate central directional light beam DBA would be redirected by optic 3 in a fashion similar to that shown in FIG. 6 for central directional light beam DB.

FIG. 8 is a perspective view of lanyard optic 3L, which is optic 3 of FIG. 3 with integral first lanyard arm 16A added to a first side and integral second lanyard arm 16B added to a second and opposite side.

FIG. 9 is alternate multi-functional illuminator 50A similar to multi-functional illuminator 50 of FIG. 1 except in FIG. 9 optic 3 has been replaced with lanyard optic 3L and lanyard 18 has been added to attach lanyard optic 3L to covert illuminator 2. Lanyard 18 is typically a 45 inch piece of nylon cord. It passes through light lanyard hole one 17A and light lanyard hole two 17B of covert illuminator 2. Each end of lanyard 18 is then attached to lanyard optic 3L.

FIG. 10 is alternate multi-functional illuminator 50A of FIG. 9 except lanyard optic 3L has been removed from bezel 9 and placed at the opposite end of covert illuminator 2. Lanyard 18 is long enough so that a person can place lanyard 18 over his head at lanyard loop opening X disposing alternate multi-functional illuminator 50A around his neck with covert illuminator 2 in front of him and lanyard optic 3L at the back of his neck (not shown).

FIG. 11 is a perspective view of lanyard optic 3L removed from FIG. 10. It shows one end of lanyard 18 entering lanyard hole two H2 of first lanyard arm 16A looping around first lanyard arm 16A and exiting lanyard hole one H1. After exiting lanyard hole one H1 the end of lanyard 18 can be optionally tied into a knot to prevent it from pulling free of lanyard optic 3L. Leaving the end of lanyard 18 unknotted—after passing through covert illuminator 2—has an advantage in that it permits covert illuminator 2 to be pulled free without injuring the person having the assembly about his neck in the instance that covert illuminator 2 is accidentally pulled by machinery or other means. The opposite end of lanyard 18 is similarly attached to second lanyard arm 16B on the opposite side of lanyard optic 3L. Lanyard 18 is looped around and through lanyard arms 16A and 16B such that it permits lanyard 18 to be pulled through lanyard optic 3L yet due to the friction created by the looping mechanism it resists changing its position. Lanyard 18 is therefore frictionally connected to lanyard optic 3L permitting the size of lanyard loop opening X to be adjusted to fit the neck of the user.

In order for the present multi-functional illuminator to be functional, it is important that lanyard optic 3L always be readily available. Looking back at FIGS. 9 and 10 it can be seen that by connecting lanyard optic 3L to covert illuminator 2 with lanyard 18, a person is assured that it will not be displaced or lost. In addition, by frictionally connecting lanyard 18 with lanyard optic 3L the user of the device can adjust the position of covert illuminator 2 up-and-down in front of him until he selects the desired location for covert illuminator 2. Equipment used in military aircraft is considered unacceptable if components can be separated as separated components are a serious hazard if they fly around the cockpit during high-speed maneuvers. Attaching lanyard optic 3L at two locations is especially desirable for aircraft pilots because this method of attachment assures that lanyard optic 3L will not become separated from covert illuminator 2 thereby creating a hazardous foreign object in the cockpit.

In FIG. 12 top 20 typically molded of transparent plastic has been added to optic 3 of FIG. 5. Top 20 is hermetically sealed to optic 3 to prevent dirt and water from entering air pocket 15 as these elements would decrease the reflectivity of reflective surface 14. Top 20 can alternatively be of an opaque plastic for those tasks for which visibility of the multi-functional illuminator from above is not desirable.

FIG. 13 is a partial sectional view similar to FIG. 5 except optic 3 has been replaced with alternate optic 3A. Looking at FIG. 6 it can be seen that optic 3 was designed to redirect central directional light beam DB to create redirected light beam RB. Redirected light beam RB is concentrated about horizontal reference plane H throughout a 360 degree azimuth. Alternate optic 3A as seen in FIG. 13 includes alternate redirecting surface 14 A and alternate included angle AA, such that central directional light beam DB is redirected to create alternate redirected light RLA. Alternate redirected light RLA is substantially evenly distributed throughout the hemisphere and centered about vertical reference V. Alternate optic 3A creates an evenly distributed hemispherical light pattern by changing included angle A of optic 3 to alternate included angle AA of alternate optic 3A and changing highly polished reflective surface 14 of optic 3 to alternate redirecting surface 14A. Alternate redirecting surface 14A includes a quantity of ridges or refracting elements alternating with polished reflecting elements. There are numerous combinations of alternate included angle AA and alternate redirecting surface 14A contours each of which can effect a particular desired light distribution. The contour depicted in FIG. 13 is symbolic showing both reflection and refraction. Diffusing optics can be added by including fine scratches on portions of alternate redirecting surface 14A. The alternate redirected light RLA can have light patterns other than evenly distributed throughout the hemisphere. The exact combination of optical redirectors (shapes) which achieve a desired light pattern can be established using classical optics and will depend upon the exact pattern required of alternate redirected light RLA.

FIG. 14 is a front view of multi-functional illuminator 50 of FIG. 1 showing redirected light beam RB which would be emitted from multi-functional illuminator 50 with optic 3 in bezel 9. Optic 3 is approximately one inch in diameter and extends three quarters of an inch beyond hood 9A. Redirected light beam RB includes included angle of redirected light beam AR centered about horizontal reference plane H and visible throughout a 360° azimuth. This is a typical beam pattern as would be employed for a signal light. The present invention can be modified to redirect the light to achieve any one of a variety of beam patterns including a single azimuthal direction in place of the 360 degree arc depending upon the planned use of the device. It is noteworthy to realize that optic 3 as shown in FIG. 14 does not appear as if it is evenly glowing. In fact, it appears as if it is emitting light from intense spot S. Intense spot S is shown as triangular but can have a variety of shapes depending upon the exact optics included in optic 3. For designs which use diffusing or refractive optics to redirect central directional light beam DB large portions of optic 3 could glow possibly making optic 3 appear as an evenly glowing light source larger in size but less intense than intense spot S. In some situations the visibility of intense spot S would be superior to the visibility of a larger evenly glowing optic 3 even though both are transmitting equal amounts of light.

FIG. 15 is similar to FIG. 14 except optic 3 has been replaced with alternate optic 3A from FIG. 13. Replacing optic 3 with alternate optic 3A changes the emerging light from redirected light beam RB to alternate redirected light RLA which represents emitted light substantially evenly distributed throughout a hemisphere. Alternate redirected light RLA is not concentrated into the intense light beam of redirected light beam RB because the FIG. 15 configuration is designed to evenly illuminate a tent or room or to be equally visible from all points within a hemisphere.

FIG. 16 is a front view of substitute covert illuminator 2C. Substitute covert illuminator 2C emits substitute central directional light beam DBS centered about directional light beam axis BA. Substitute central directional light beam DBS has an angular divergence identified as included angle of substitute directional light beam ABS. Central directional light beam DB, as previously described in FIG. 4, is also concentrated about central directional light beam axis BA and also optionally includes an angular beam spread. Substitute covert illuminator 2C differs from covert illuminator 2 in that its emerging light is a composite of a plurality of discrete light beams. Its emerging composite light beam can have a different angular beam spread from that of covert illuminator 2. Substitute covert illuminator 2C further differs from covert illuminator 2 in that it includes substitute case 1A in place of case 1. Substitute case 1A comprises switch SW having a plurality of switch positions. In addition printed circuit board 5B and a plurality of LED lamps, both to be later described in FIG. 17, have replaced catadioptric lens 7, LED lamp 6 and printed circuit board 5 of covert illuminator 2. Switch SW position one P1 is typically the "off" position. Position two P2, position three P3, position four P4, and position five P5 are switch positions which can be used to select color options and mode options controlling the illuminators emitted color and mode (flashing, steady etc) of operation. The number of switch positions can be varied in order to accommodate a multiplicity of illuminator functions.

FIG. 17 is similar to FIG. 6 except covert illuminator 2 has been replaced with substitute covert illuminator 2C from FIG. 16. In FIG. 17 substitute covert illuminator 2C includes a plurality of T 1¾ LED lamps (LED light sources) disposed on printed circuit board 5B at radius R from optic axis OA replacing optic 7 and LED lamp 6 from covert illuminator 2. Depending upon the particular use LED lamps (LED light sources) other than the T 1¾ LED lamps shown can be employed. First, T 1¾ LED lamp 6A, second T 1¾ LED lamp 6B and third T 1¾ LED lamp 6C are shown disposed in a circular pattern spaced at 120° and disposed at radius R from hood axis HA, optic axis OA and vertical reference V all coincident. First T 1¾ LED lamp 6A emits alternate directional light beam from first LED lamp 6A DBAA having a related or dedicated first LED lamp 6A directional light beam axis AX1 disposed at LED radius R from hood axis HA, optic axis OA and vertical reference V all of which are coincident. Alternate directional light beam from first LED lamp 6A DBAA intersects optic 3 at reflective surface 14 whereupon it is reflected to form related or alternate reflected light beam from first LED lamp 6A RBAA which is directional and concentrated about horizontal reference plane H. Similarly, second T 1¾ LED lamp 6B emits alternate directional light beam from second LED lamp 6B DBBB having related or dedicated second LED lamp 6B directional light beam axis AX2 disposed at LED radius R from hood axis HA, optic axis OA and vertical reference V all of which are coincident. Alternate directional light beam from second LED lamp 6B DBBB intersects optic 3 at reflective surface 14 whereupon it is reflected to form alternate reflected light beam from second LED lamp 6B RBAB which is directional and concentrated about horizontal reference plane H. Third T 1¾ LED lamp 6C also functions in a similar fashion. It is noteworthy to realize that each of the LED lamps emits a light having a related or dedicated light beam axis and for the FIG. 8 configuration each beam axis is parallel to vertical reference V. Therefore optic 3 redirects the directed light beams from first LED lamp 6A DBAA, second T 1¾ LED lamp 6B and third T 1¾ LED lamp 6C to be concentrated about horizontal reference plane H. Horizontal reference plane H in the FIG. 17 configuration is a common plane perpendicular to each related beam axis. Also the light from each of the plurality of LED lamps is redirected by optic 3, such that is directed in a discrete single azimuthal direction. Hence the composite or cumulative redirected light substitute central directional light beam DBS from the three lamps—depending upon the design of the LED lamps used—may not be equally intense or equally visible throughout the 360° azimuth. For some tasks such as those currently satisfied by the common right angle flashlight this uneven intensity redirected light pattern may be acceptable or even desirable. For other uses this variable intensity redirected light pattern may be a problem. If intensity variations are a problem increasing the quantity of LED lamps placed in the circular pattern will reduce the azimuthal variations in intensity permitting the multi-functional illuminator to be equally visible from all azimuthal angles. LED lamps 6A, 6B, and 6C are typically of one color, however some tasks may employ a plurality of discrete colors. Substitute central directional light beam DBS as described in FIG. 16 is a composite light beam composed of alternate directional light beam from first LED lamp 6A DBAA, alternate directional light beam from second LED lamp 6B DBBB and the alternate directional light beams from third T 1¾ LED lamp 6C.

FIG. 17 could be alternatively be constructed with a single light source such as first T 1¾ LED lamp 6A resulting in a single redirected light beam alternate reflected light beam from first LED lamp 6A RBAA which is directional and concentrated about horizontal reference plane H. This configuration would—upon attachment of optic 2—change the covert illuminator from a device which projects its directed light beam forward and parallel to the axis of the flashlight to a multi-function illuminator projecting a directional concentrated light beam at right angles to the illuminator longitudinal axis FA of the covert illuminator effecting the equivalent of a right angle flashlight. A right angle flashlight is useful as it can be secured to the chest and direct the light forward of the person. It can also prove beneficial for maintenance personnel as the right angle light can be laid on the floor with its beam projected upward towards the ceiling FIG. 18 discloses a person with alternate multi-functional illuminator 50A from FIG. 10 placed about his neck.

FIG. 19 is a plan view of printed circuit board 5C which is similar to and can replace printed circuit board 5B from FIG. 17. Printed circuit board 5C includes three additional LED lamps L2 of a second color and three additional LED lamps L3 of a third color within the circular pattern at LED radius R from reference vertical V. Each of the LED lamps of each group of LED lamps emits a directional light beam. Each of the LED lamps is disposed at 120 degrees and alternating with LED lamps 6A, 6B and 6C. Switch SW with a circuit (not shown because it is easily assembled) could easily employ some of switch positions P1-P5 such that the operator of the flashlight could select or choose a selected group of LED lamps to emit a plurality of discrete color directional light beams thereby creating a lighting device which could emit any of the discrete colors in a composite directional beam pattern. A plurality of additional discrete colors could be added using the same concept permitting the operator to select any color from a plurality of colors and have that discrete color of light emerge in a composite directional light beam. Upon attaching optic 3 to the light a hemispherical, a 360 degree concentrated about the horizontal or any one of a plurality of alternate beam patterns in any of the discrete colors can be achieved.

The scope of the invention should be determined by the appended claims and their legal equivalents rather than by the examples given.

I claim:

1. A multi-functional illuminator comprising:

an illuminator having a transparent face and configured to have a directional light beam emerging from said face concentrated about a beam axis, said illuminator configured to be carried for directing said directional light beam, an optic removably attachable to said illuminator about said face for intersecting said directional light beam; and said optic for redirecting said directional light beam to form a redirected light beam concentrated about a plane perpendicular to said beam axis, said multi-functional illuminator configured to be carried for directing said redirected light beam.

2. A multi-functional illuminator comprising:

an illuminator having a transparent face and configured to have a flashing directional light beam emerging from said face concentrated about a beam axis, said illuminator configured to be carried for directing said directional light beam, an optic removably attachable to said illuminator about said face for intersecting said directional light beam; and said optic for redirecting said directional light beam to form a redirected light beam concentrated about a plane perpendicular to said beam axis, said multi-functional illuminator configured to be carried for directing said redirected light beam.

3. A multi-functional illuminator comprising:

an illuminator having a transparent face and configured to have a directional light beam emerging from said face concentrated about a beam axis, said illuminator configured to be carried for directing said directional light beam; and an optic removably attachable to said illuminator about said face for intersecting and redirecting said directional light beam to form a redirected light beam concentrated about a plane perpendicular to said related beam axis, said optic further attached to said illuminator not intersecting said directional light beam, said multi-functional illuminator configured to be carried for directing said redirected light beam.

4. A multi-functional illuminator comprising:

an illuminator having a transparent face and configured to have a directional light beam emerging from said transparent face concentrated about a beam axis, said illuminator configured to be carried for directing said directional light beam, said directional light beam having a color of an LED light source of said illuminator; and an optic removably attachable to said illuminator about said face for intersecting and redirecting said directional light beam to form a redirected light beam concentrated about a plane perpendicular to said related beam axis, said multi-functional illuminator configured to be carried for directed said redirected light beam.

5. The multi-functional illuminator according to any of claims 1, 2, 3 or 4 further comprising:

said optic connected to said illuminator with a lanyard.

6. The multi-functional illuminator according to any of claims 1, 2, 3 or 4 further comprising:

said optic further redirecting said directional light beam throughout a 360 degree arc.

7. The multi-functional illuminator according to any of claims 1, 2, 3 or 4 further comprising:

said optic configured to employ total internal reflection to effect redirecting said directional light beam.

8. The multi-functional illuminator according to any of claims 1, 2, or 3 further comprising:

said illuminator having an LED light source and a catadioptric lens for forming said directional light beam.

9. The multi-functional illuminator according to any of claims 1, 2, 3 or 4 further comprising:

said optic further removably attachable to said illuminator forming a water tight seal between said optic and said illuminator.

10. The multi-functional illuminator according to any of claims 1, 2 or 4 further comprising:

said optic further attachable to said illuminator and not intersecting said directional light beam.

11. The multi-functional illuminator according to any of claims 1, 2, 3 or 4 further comprising:

said optic further redirecting said directional light beam to effect a redirected light distributed throughout a hemisphere.

12. The multi-functional illuminator according to any of claims 1, 2, 3 or 5 further comprising:

said illuminator having a plurality of LED light sources having a distinct color, and said multi-functional illuminator having a switch for selectively energizing each LED light source of the plurality of LED light sources.

13. The multi-functional illuminator according to any of claims 1, 3 or 4 further comprising:

said transparent face recessed at least 0.2 inches within a tubular opaque bezel for reducing a detectability of said illuminator.

14. A multi-functional illuminator comprising:

an illuminator having a transparent face, said illuminator having a plurality of LED light sources, each said LED light source of the plurality of LED light sources having a related directional light beam emerging from said transparent face concentrated about a related beam axis; and an optic removably attachable to said illuminator about said face for intersecting and redirecting each said related directional light beam to form a related redirected light beam concentrated about a plane perpendicular to said related beam axis.

15. The multi-functional illuminator of claim 14 wherein each LED light source of the plurality of LED light sources has a distinct color, and said multi-functional illuminator having a switch for selectively energizing each LED light source of the plurality of LED light sources.

16. The multi-functional illuminator of claim 14 wherein at least one related directional light beam is a flashing light beam.

17. A multi-functional illuminator comprising:

an illuminator having a transparent face, said transparent face recessed at least 0.2 inches within a tubular opaque bezel, said illuminator having an LED emitter, said LED emitter having a directional light beam emerging from said transparent face; and an optic removably attachable to said illuminator about said face for intersecting and redirecting said directional light beam to effect a redirected light having a light beam concentrated about a plane perpendicular to a longitudinal axis of said illuminator throughout a 360 degree arc.

18. The multi-functional illuminator of claim 17 further comprising:

said optic connected to said illuminator with a lanyard.

19. The multi-functional illuminator of claim 17 further comprising:

said optic employing total internal reflection and having a hermetically sealed air pocket.

* * * * *